United States Patent [19]

Harrold et al.

[11] 4,296,003

[45] Oct. 20, 1981

[54] ATOMIZED DIELECTRIC FLUID COMPOSITION WITH HIGH ELECTRICAL STRENGTH

[75] Inventors: Ronald T. Harrold, Murrysville; Lawrence E. Ottenberg, East Huntingdon Township, Westmorland County, both of Pa.

[73] Assignee: Electric Power Research Institute, Inc., Palo Alto, Calif.

[21] Appl. No.: 163,901

[22] Filed: Jun. 27, 1980

[51] Int. Cl.[3] ..... H01B 3/24

[52] U.S. Cl. ..... 252/570; 174/15 R; 174/17 GF; 252/574; 252/575; 252/578; 252/571

[58] Field of Search ..... 252/63, 63.5, 66, 65, 252/570; 174/15 R, 17 GF

[56] References Cited

U.S. PATENT DOCUMENTS

| | | | |
|---|---|---|---|
| 2,019,338 | 10/1935 | Clark | 252/66 |
| 2,221,670 | 11/1940 | Cooper | 174/17 GF |
| 2,990,443 | 6/1961 | Camilli | 174/15 R |
| 3,249,681 | 5/1966 | Eiseman | 174/17 GF |
| 4,162,227 | 7/1979 | Cooke | 252/63 X |

*Primary Examiner*—Mayer Weinblatt
*Attorney, Agent, or Firm*—L. P. Johns

[57] ABSTRACT

A dielectric fluid composition with high electrical strength characterized by a first fluid selected from the group consisting of electronegative gases, such as $SF_6$, $CCl_2F_2$, $C_2F_6$, $CF_3Cl$, and $CF_4$, and mixtures thereof; or from another group consisting of electropositive gases, such as $N_2$ and $CO_2$, and mixtures thereof; or from mixtures of the two groups; and a second fluid from a group of atomized liquids, which may be chlorinated liquid, such as, $C_2Cl_4$ (tetrachloroethylene); and fluorocarbon liquids, such as, $C_8F_{16}O$ (perfluorodibutyl ether), and mixtures thereof.

14 Claims, 4 Drawing Figures

ATOMIZED DIELECTRIC FLUID COMPOSITION WITH HIGH ELECTRICAL STRENGTH

CONTRACT

This invention was conceived during the performance of work under Contract No. RP-930-1 for the Electric Power Research Institute.

CROSS-REFERENCE TO RELATED APPLICATIONS

This application is related to copending application of Ronald T. Harrold, Ser. No. 163,902, filed June 27, 1980.

BACKGROUND OF THE INVENTION

1. Field of the Invention

This invention relates to a dielectric fluid composition and, more particularly, it pertains to mixtures of atomized dielectric fluids and insulating gases for high electrical strength.

2. Description of the Prior Art

As a general rule, the higher the density of an insulating liquid or gas, the higher is its electrical strength. Sulphur hexafluoride ($SF_6$) gas, for example, is about five times denser than air and has a breakdown strength which is about 2.5 times higher, while compressed $SF_6$ has even higher dielectric strength. One problem in compressing a gas to obtain a high electrical strength is that a stronger vessel is needed to contain the gas. Another consideration is the high cost of $SF_6$ when large quantities are required, as in the case with transmission lines. As pointed out in U.S. Pat. No. 4,162,227, it is for these reasons that gas mixtures are employed, so that a high strength, high cost, dielectric gas may be mixed with a poorer one of lower cost, to provide a mixture with a dielectric strength somewhere between the strength values for each of the two mixture components. Also, in the same patent it is noted that for some gas mixtures, the dielectric strength may be higher than either component strength at the same temperature and pressure of the mixture.

In U.S. Pat. No. 2,990,443 a gas-insulated transformer is described in which $SF_6$ gas provides the insulation. To remove heat during the transformer operation, an atomized fluid is introduced into the $SF_6$ gas and circulated throughout the transformer windings and core. It is inferred that the atomized fluid does not reduce the dielectric strength of the $SF_6$, and it is emphasized that the function of the $SF_6$ is to provide electrical insulation.

As can be seen from the discussion of the prior art, it is well known that certain gas mixtures can have a high electrical strength, and that an atomized fluid can be mixed with $SF_6$ without reducing the electrical strength of $SF_6$. It is an object of this invention to provide a gas/atomized fluid mixture of much higher dielectric strength than the gas at the same temperature and pressure. Another object of this invention is to define the range of droplet sizes required in order to the gas/atomized fluid to have a high dielectric strength. A further object of this invention is to provide a method of atomizing a dielectric fluid and introducing the droplets into the gas. Other features and merits of this invention will appear hereinafter.

SUMMARY OF THE INVENTION

In accordance with this invention a dielectric fluid composition is provided which comprises a mixture of two fluids; one of which is selected from one group consisting of electronegative gases, such as $SF_6$, $CCl_2F_2$, $C_2F_6$, $CF_3Cl$, and $CF_4$, and mixtures thereof; or from another group consisting of electropositive gases, such as $N_2$ and $CO_2$, and mixtures thereof; or even from mixtures of the two groups. The other fluid in the mixture is selected from a group of atomized liquids which may be chlorinated liquids, such as tetrachloroethylene ($C_2Cl_4$), or fluorocarbon liquids, such as perfluorodibutyl ether ($C_8F_{16}O$), and mixtures thereof.

The advantage of the dielectric fluid of this invention is that the dielectric strength of the atomized dielectric fluid-insulating gas mixture is considerably greater than the gas alone. Typically, at one atmosphere pressure the atomized dielectric fluid-insulating gas mixture will be twice as strong as either gas alone, while at lower pressures near 40 torr, it will be more than ten times stronger than either gas alone. Primarily, because of the discovery that these fluid compositions can have high electrical strength, and as atomized droplets can be generated rapidly, a system of this form gives improved dielectric strength during cold start-ups of a vapor-cooled power transformer. Secondly, because the dielectric fluid can be atomized acoustically, then by a suitable choice of power and frequency input to a piezoceramic transducer, a liquid jet spray can be produced, thereby opening up the possibility of replacing the spray system and pump used in the conventional type of vapor-cooled power transformers. Thirdly, an atomized liquid system has good cooling characteristics.

As explained more fully below, it appears that in order for the atomized dielectric fluid-insulating gas mixtures to have high electrical strength, the droplets must be in the range of from approximately $0.1\mu$ to about $25\mu$ in diameter.

DESCRIPTION OF THE PREFERRED EMBODIMENTS

Figure 1:
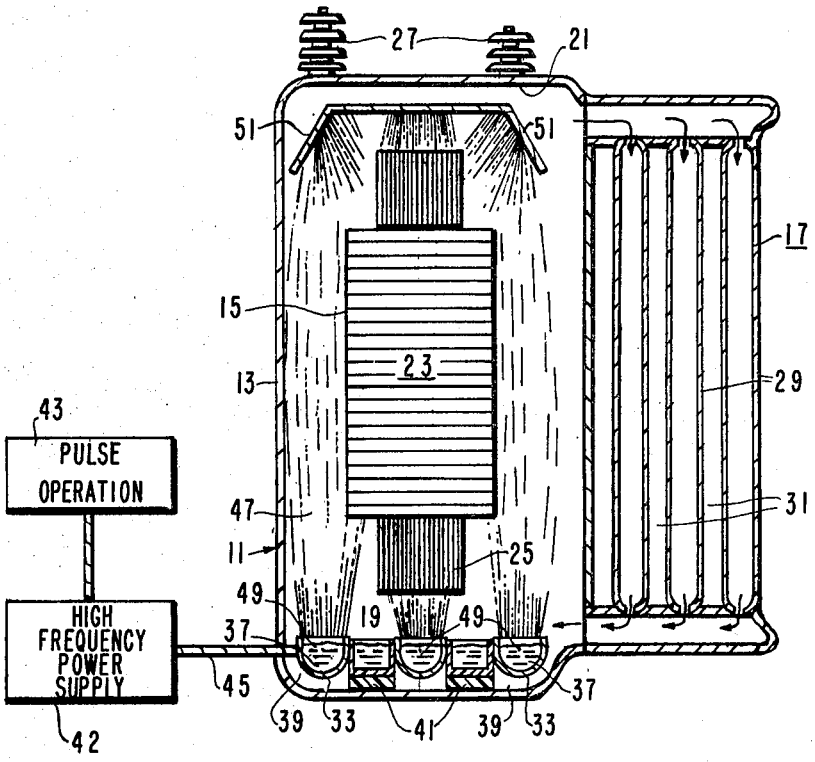
FIG. 1 is a vertical sectional view showing an acoustic fountain vapor-cooled power transformer.

The dielectric fluid compositions disclosed herein may be used for cooling a heat-producing member within a chamber, such as for example, x-ray equipment, radar, and a transformer. For illustration in FIG. 1 a power transformer is generally indicated at 11 and it comprises a sealed housing 13, electric heat-developing apparatus such as a transformer 15, and a condenser cooler 17. The power transformer 11 also comprises means 19 for applying ultrasonic vibrations. The housings 13 are a sealed enclosure providing an internal chamber 21 in which the transformer 15, the condenser cooler 17 and the means 19 are disposed. The housing 13 is comprised of a suitable rigid material such as a metal or a glass fiber.

The transformer 15 includes a magnetic core and the coil assembly having electric windings 23 which are disposed in inductive relation with a magnetic core 25. For simplification, the drawings do not show a support structure or electric leads to the windings 23 and a pair of electric bushings are shown by way of example for two or more similar bushings.

The condenser cooler 17 comprises a plurality of tubes 29 separated by spaces 31 through which ambient gases, such as air circulate in heat exchange relation with the contents of the tubes. The upper ends of the tubes communicate with the upper portion of the chamber 21 and the lower ends communicate with the lower portion of said chamber, whereby vapor and mist enter the upper ends of the tubes and, upon condensation, drain into the lower portion of the chamber to be recycled as vapor as set forth hereinbelow.

The means 19 for applying ultrasonic vibration is disposed at the lower end portion of the housing 13 and is comprised of at least one ultrasonic vibration-producing device or transducer 33. A suitable piezoceramic member is PZT-4 which is product of the Piezoelectric Division of Vernitron Corporation, Bedford, Ohio. The preferred form of the device 33 is a piezoceramic member having a concaved or bowl-shaped configuration for focussing ultrasonic vibration onto the surface of a suitable insulating liquid contained in the member. A plurality, such as six bowl-like devices or bowls 33 are located in the lower portion of the chamber 21. The devices 33 are spaced from each other and the spaces are occupied by containers 35 which, like the devices 33 are filled with suitable insulating liquid 37. The upper peripheral portions of the bowls 33 and the containers 35 are in liquid-tight contact so that the level of the liquid in the devices and the containers is maintained at a preselected depth. The containers 35, being filled with insulating liquid 37, serve as reservoirs for the devices 33. As the liquid condenses in the cooler 17, it returns to the containers 35 where the liquid overflows into the several devices 33 where proper liquid level is maintained for optimum vapor production. The devices 33 are supported above spaces filled with a material having a low acoustic impedance in relation to the liquid, such as air or $SF_6$. Several containers 35 are supported on material 41 such as tetrafluoroethylene (Teflon).

The devices 33 are powered by a power supply 42 having a pulse device 43 associated therewith. A power cable 45 extends from the power supply 42 to the ultrasonic vibration-producing devices 33 which are comprised of piezoceramic material. When power is received by the devices 33, the ultrasonic vibrations generated are directed and focused by the bowl-like configurations thereof onto the surface of the insulating liquid 37. As a result, the liquid 37 is cavitated and vaporized by the high-frequency soundwaves generated by the piezoceramic material which cause the surface portions of the liquid to be agitated and projected upwardly to form an acoustic fountain 47 of micromist and vapor molecules in the chamber 21 around and above the transformer windings 23 and core 25 as well as onto the surfaces and crevices and openings therein.

The devices 33 have a preferred diameter of about 10 centimeters and their thickness can be selected so that they can operate at a frequency in the range of from about 0.1 to about 5 MHz frequency. The devices are provided with a backing of air or $SF_6$ so that maximum acoustic energy is directed toward a focal point 49. An arrangement of devices 33 may include 6 equally spaced bowls operated via a high frequency power supply of about 1 kilowatt. The exact input power varies and an arrangement of focussing devices as well as operating frequency depends upon other factors such as the liquid used.

A suitable liquid for this purpose is tetrachloroethylene ($C_2Cl_4$).

The acoustic fountains 47 may operate continuously with operation of the transformer 15, or on the other hand, depending upon the pumping efficiency, pulsed operation is possible with a high repetitive rate when the transformer is first switched on and lower rates are used later when the core and coils are at normal operating temperatures. To ensure adequate electrical strength of the micromist at the beginning operation, the acoustic fountain 47 of mist may be activated perhaps 10 seconds or so before the transformer is energized by using a timing sequence. The acoustic fountains 47 project about 1 to 3 meters in height and may be used in conjunction with strategically placed deflectors 51 to ensure adequate coverage of the coil 23 and the core 25.

As the transformer continues to operate, the micromist and vapor fill the internal chamber 21. The micromist vaporizes upon contact with the hot surfaces of the core and windings and the vapor then passes across the top of the chamber into the condenser cooler 17, where it in contact with the tubes 29, the vapors condense, drain to the bottom of the cooler, and return to the lower or sump area of the transformer for recycling.

In accordance with this invention, the insulating liquid 37 is a dielectric fluid composition comprising a mixture of two fluids; one of which is selected from one group consisting of electronegative gases, such as, $SF_6$ $CCl_2F_2$, $C_2F_6$, $CF_3Cl$, and $CF_4$, and mixtures thereof; or from another group consisting of electropositive gases, such as, $N_2$ and $CO_2$, and mixtures thereof; or even from mixtures of the two groups. The other fluid in the mixture is selected from the group consisting of atomized liquids which may be chlorinated liquids, such as $C_2Cl_4$ (tetrachloroethylene), or fluorocarbon liquids, such as, $C_8F_{16}O$ (perfluorodibutyl ether), or mixtures thereof. A mixture of $SF_6$ and $C_2Cl_4$ comprises an example of the dielectric fluid composition. The electrical breakdown strength of atomized dielectric fluid-insulated gas mixtures is significant because such mixtures have high electrical strength, and inasmuch as the atomized droplets are generated rapidly, it provides improved dielectric strength during cold start-up of a vapor-cooled power transformer. Moreover, because the dielectric fluid is atomized acoustically a liquid jet or spray is produced by a suitable choice of power and frequency. As a result it is possible to replace the spray system and pump used in the usual type of vapor-cooled power transformers of prior construction. Moreover, an atomized liquid system has good cooling characteristics.

Figure 2:
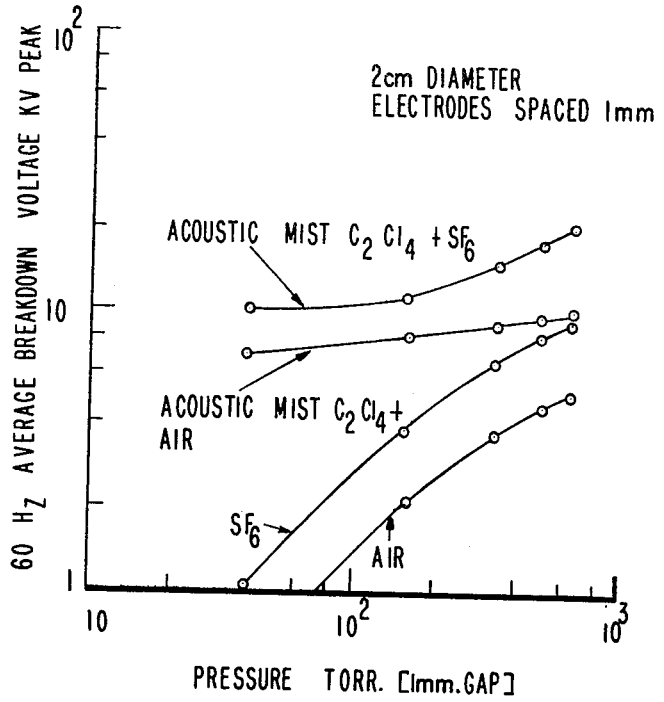
FIG. 2 is a graph showing the average electrical breakdown strength versus pressure for mixtures of acoustically atomized dielectric fluids and insulating gases, and/or gases.
Figure 3:
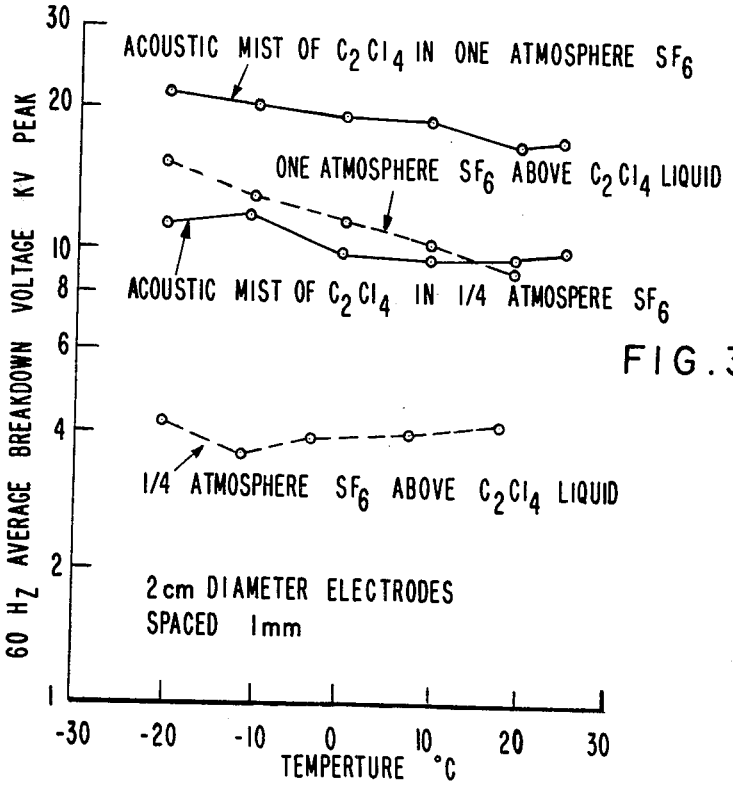
FIG. 3 is a graph showing the electrical breakdown strength versus temperature for a mixture of acoustic mist (atomized fluid) of $C_2Cl_4$ and $SF_6$ at different pressures.

With regard to atomized dielectric fluid-insulating gas mixtures, breakdown voltage data are illustrated in FIGS. 2 and 3. The atomized dielectric fluid was tetrachloroethylene ($C_2Cl_4$) and the insulating gases used were sulphurhexafluoride ($SF_6$) and air. As the atomization was carried out acoustically, the mixtures were referred to as acoustic mist $C_2Cl_4$ plus $SF_6$. The breakdown voltage curves in FIG. 2 include mixtures of acoustic mist $C_2Cl_4$ plus $SF_6$, acoustic mist $C_2Cl_4$ plus air, and the gases $SF_6$ and air, over a pressure of about 40 Torr to about 730 Torr. In FIG. 3, breakdown data are plotted at one quarter atmosphere and one atmosphere for acoustic mist $C_2Cl_4$ plus $SF_6$, but over a temperature range of from −20° C. to +25° C.

At one atmosphere pressure (FIG. 2) the acoustic mist $C_2Cl_4$ and $SF_6$ mixture has twice the breakdown strength of $SF_6$, while at 40 Torr pressure it is ten times as strong. The high dielectric strength (FIG. 3) of the acoustic mist $C_2Cl_4$ and $SF_6$ mixture is maintained over the temperature range of from −20° C. to +25° C. Also, the breakdown voltage at 1 mm gap (FIG. 3) in one atmosphere $SF_6$ above $C_2Cl_4$ liquid in a closed vessel is about 15 kVpk at −20° C., as compared with the breakdown voltage in $SF_6$ alone at one atmosphere (FIG. 2) which is about 9 kVpk. In effect, by saturating the $SF_6$ with $C_2Cl_4$ vapor, at one atmosphere, the breakdown strength of $SF_6$ is improved greater than 60%, which would be expected from prior art (U.S. Pat. No. 4,162,227). The breakdown voltage data (FIG. 4) are presented for a 1 mm gap over the pressure range of about 100 Torr to atmospheric pressure (about 730 Torr) for $SF_6$ gas, $C_2Cl_4$ vapor, and acoustic mist $C_2Cl_4$ plus $SF_6$. The $C_2Cl_4$ vapor is electrically stronger than $SF_6$, and acoustic mist $C_2Cl_4$ plus $SF_6$ is electrically stronger than $C_2Cl_4$ vapor. Specifically, at one atmosphere, $C_2Cl_4$ vapor is about 60% stronger than $SF_6$, while the acoustic mist $C_2Cl_4$ plus $SF_6$ is about twice as strong as $SF_6$. The vapor pressure/temperature measurements for $C_2Cl_4$ are also illustrated (FIG. 4) and show that about 80 watts of power are required to heat 700 cc of $C_2Cl_4$ fluid, to obtain a vapor pressure of about 400 Torr in four hours ($10^5$ joules of energy). The breakdown voltage versus pressure curve for $C_2Cl_4$ can also be calculated from the following formula:

$$V_2 = V_1 e\,(P_2 - P_2/P),$$

where P=730 Torr

It has been known since 1889 (K. Natterer, Anal. Phys. Chem. 88,663, 1889), that vapors of carbon tetrachloride ($CCl_4$) can increase the dielectric strength of air at atmospheric pressure. Moreover, it is known that vapors of tetrachloroethylene ($C_2Cl_4$) increase the dielectric strength of $SF_6$ at one atmosphere by about 50%. The effects are probably due to the increased density of the "gas" as the vapors mix with it. Moreover, U.S. Pat. No. 4,162,227 discloses that the dielectric strength of mixtures of two or more gases can be higher than that of any of the individual gases at the same temperature and pressure, provided that the strength of one or more of the gases increases at less than one linear rate with increasing pressure.

Thus, small quantities of $C_2Cl_4$ vapor enhance the dielectric strength of $SF_6$ gas and the atomizing technique described previously represents a rapid method of introducing vapor into a gas, as set forth below.

The vapor pressure associated with liquid droplets is higher than the saturated vapor pressure (SVP) above a liquid and its value is calculated from the following equation derived by Lord Kelvin:

$$\ln(P/P_o) = (2M\alpha/RT\rho\tau),$$

where $P_o$ is the saturated vapor pressure over a flat surface; P is the saturated vapor pressure at the droplet surface; M is the molecular weight of the droplet; $\alpha$ is the droplet surface tension in dyne-cm; $\rho$ is the droplet density in gm/cm$^3$; R is the gas constant and T is the absolute temperature in °K.; and $\tau$ is the droplet radius in cm.

Saturated vapor pressure for droplets of water and $C_2Cl_4$ at 20° C., ranging in size from 0.002$\mu$ to 100$\mu$ in diameter, in air, are given in Table 1 below:

TABLE 1

VAPOR PRESSURES OF WATER AND $C_2Cl_4$ DROPLETS IN AIR (25° C.)

| | | | | | | |
|---|---|---|---|---|---|---|
| Droplet Diameter ($\mu$) | 0.002 | 0.02 | 0.2 | 2.0 | 30 | 100 |
| Droplet Radius (cm) | $10^{-7}$ | $10^{-6}$ | $10^{-5}$ | $10^{-4}$ | $15 \times 10^{-4}$ | $5 \times 10^{-3}$ |
| P/P water droplets in air | 3.16 | 1.13 | 1.012 | 1.001 | 1.00008 | 1.000024 |
| $P/P_o$ $C_2Cl_4$ droplets in air | 13.74 | 1.30 | 1.027 | 1.0026 | 1.00026 | 1.000026 |

The saturated vapor pressure in a gas above a liquid, and the saturated vapor pressure of liquid droplets in the gas are factors which determine the rate of evaporation of the droplet and its stability. In order, for say, a 0.2$\mu$ diameter droplet of $C_2Cl_4$ to be stabilized in air, the vapor associated with the droplet must be supersaturated to the extent of 1.027 (Table 1). In other words, at 25° C. the SVP for $C_2Cl_4$ is about 18 Torr, so for the 0.2$\mu$ droplet to be stable the super saturation would have to be 1.027 times 18 Torr, or about 18.5 Torr. If this condition is not met, the droplet will evaporate. As the 0.2$\mu$ droplet would only enhance the SVP by about 3%, and a 30$\mu$ droplet would only have a about 0.01% effect, there would be minimal effect on the electrical breakdown of the vapor through supersaturation. However, these vapor pressure considerations explain one function of the acoustic mist $C_2Cl_4$ in $SF_6$. Probably $C_2Cl_4$ droplets in the 1 to 10$\mu$ range, in $SF_6$ gas, will evaporate until the gas is supersaturated and the droplet diameter is stable. It is probable for droplets with a mean diameter of about 5$\mu$, as they fall slowly (0.25 cm/sec), but not for approximately 30$\mu$ droplets which fall at a rate near 2.5 centimeters per second. From the action of an acoustic mist of $C_2Cl_4$ saturating $SF_6$ an increase of the breakdown strength of about 50% at 25° C. (FIG. 4) is expected. In practice it has been found that after a "shot" of acoustic mist of $C_2Cl_4$ into $SF_6$ gas, and after the droplets have settled out and are back in the main body of liquid, the $SF_6$ breakdown strength is improved by about 50%.

Figure 4:
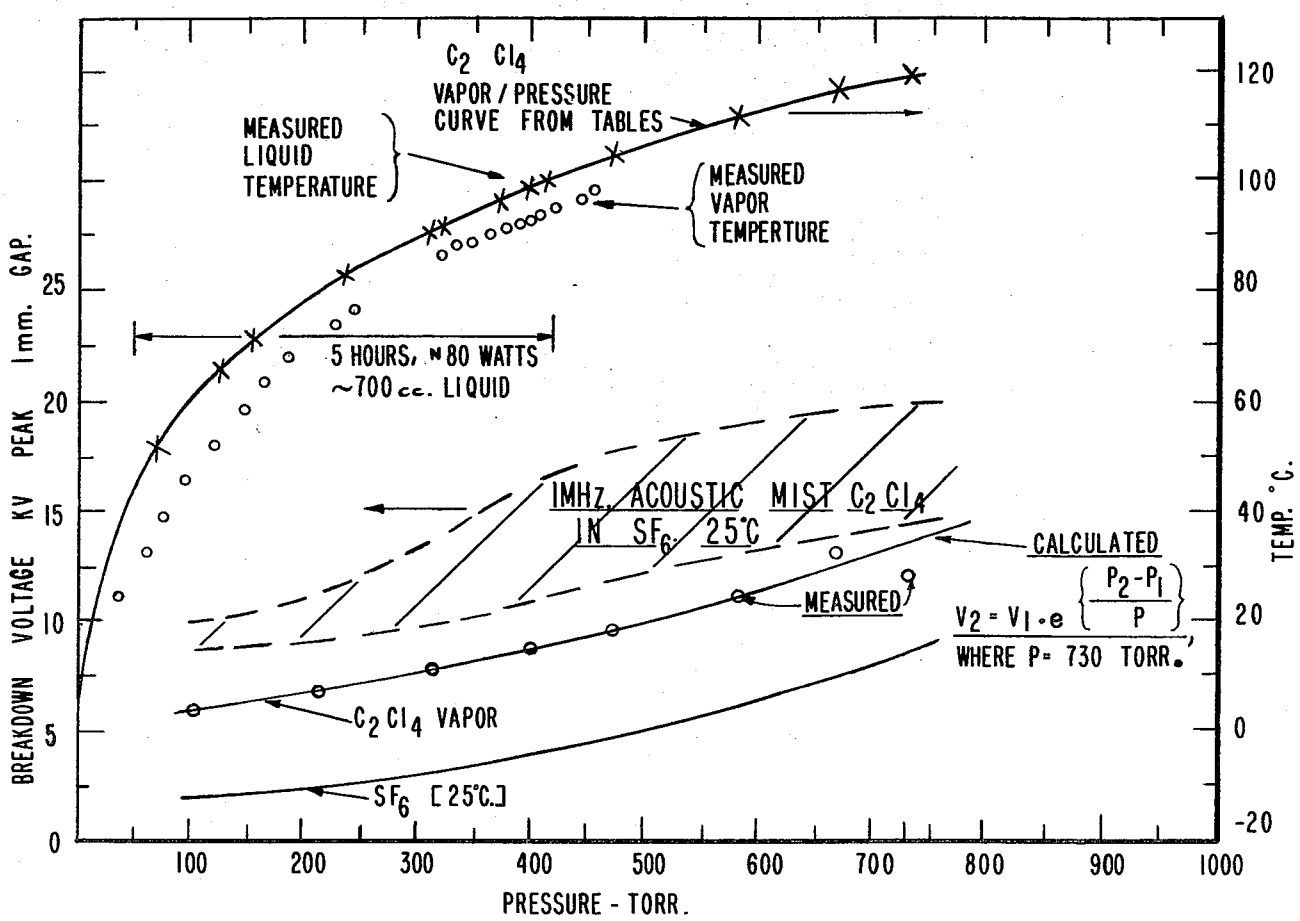
FIG. 4 is a graph showing the $C_2Cl_4$ vapor temperature and breakdown voltages of $SF_6$, $C_2Cl_4$ vapor and for the mixture of acoustic mist $C_2Cl_4$ and $SF_6$.

The saturation of the $SF_6$ with $C_2Cl_4$ plus vapor via the acoustic mist partly explains the high electrical strength of the acoustic mist $C_2Cl_4$ plus $SF_6$ mixture, but breakdown in the mist plus vapor plus $SF_6$ is higher than breakdown of vapor plus $SF_6$ (FIG. 4). The further increase in strength is believed to be due to electron capture by the droplets.

Approximate measurements of the droplet diameters of acoustic mist $C_2Cl_4$ were made both with a microscope and by calculation using Stoke's Law and measurements of the velocity of the droplet descent. The $C_2Cl_4$ mist droplets which increased the electrical breakdown strength of $SF_6$ ranged in diameter from about 1 to 10$\mu$, and averaged approximately 7$\mu$ in diameter. Mist droplets which did not increase the $SF_6$ strength and even reduced the strength appear to be greater or equal to 30μ in diameter. The droplet size has a working range of from about 0.1μ to about 25μ in diameter and a preferred range of from about 1μ to about 10μ. The best mists were very dense, and the mist density in droplets/cc has not been measured, but a reasonable estimate is made from the literature and examples are given in Table II below:

TABLE II

| Mass/cm$^3$ | Mean Droplet Diameter μ | Droplets Per cm$^3$ | Est. Distance Between Dropletsμ |
|---|---|---|---|
| 2.3 μgm. Rain Cloud: | 33 | 120 | 2000 |
| 0.63 μgm. Dense Sea Mist: | 10 | 1200 | 1000 |
| 10.0 μgm. Acoustic Mist NaCl 1.2 mHz. | 5 | $\sim 2 \times 10^5$ | 180 |

From Table II it is evident that acoustic mists are extremely dense, but with a distance between droplets about 180μ, the dimensions do not approach the mean free path of electrons which would be a maximum of about 1μ. Although the mist density does not nearly approach the density of the gas molecules, it is believed that with about 2 times $10^5$ droplets per cubic centimeter, there is a high probability of capturing electrons before an electron avalanch can form and lead to an electrical breakdown.

The hypothesis is that the high electrical strength of the acoustic mist $C_2Cl_4+SF_6$ is due to a combination of the strength of the gas-vapor mixture and the capture of electrons by the droplets of $C_2Cl_4$.

What is claimed is:

1. A dielectric fluid composition consisting of a mixture of (a) a first fluid selected from the group consisting of electronegative gases, electropositive gases, and mixtures thereof, and (b) a second fluid including an atomized liquid selected from the group consisting of chlorinated liquids, fluorocarbon liquids, and mixtures thereof and having a droplet size of from about 0.1μ to about 25μ in diameter, and wherein the mixture has a pressure of from about 40 Torr to about 730 Torr.

2. The composition of claim 1 wherein the first fluid is $SF_6$.

3. The composition of claim 1 wherein the first fluid is $CCl_2F_2$.

4. The composition of claim 1 wherein the first fluid is $C_2F_6$.

5. The composition of claim 1 wherein the first fluid is $CF_3Cl$.

6. The composition of claim 1 wherein the first fluid is $CF_4$.

7. The composition of claim 1 wherein the first fluid is $N_2$.

8. The composition of claim 1 wherein the first fluid is $CO_2$.

9. The composition of claim 1 wherein the droplet size is from about 1μ to about 10μ.

10. The composition of claim 1 wherein the second fluid has a density factor of from about $2\times10^3$ about $2\times10^5$ droplets per cc.

11. The composition of claim 1 wherein the second fluid is a fluorocarbon.

12. The composition of claim 11 wherein the second fluid is $C_8F_{16}O$.

13. The composition of claim 1 wherein the second fluid is a chlorinated liquid.

14. The composition of claim 13 wherein the second fluid is $C_2Cl_4$.

* * * * *